United States Patent [19]

Heck

[11] 4,381,846

[45] May 3, 1983

[54] REFILL WITH FLEXIBLE MESH SCREEN FOR LIQUID DISPENSER

[75] Inventor: Samuel C. Heck, San Antonio, Tex.

[73] Assignee: Sani-Fresh International, Inc., San Antonio, Tex.

[21] Appl. No.: 214,977

[22] Filed: Dec. 10, 1980

[51] Int. Cl.[3] ..... B65D 37/00

[52] U.S. Cl. ..... 222/105; 222/183; 222/189; 222/529

[58] Field of Search ..... 222/95, 105, 183, 189, 222/386.5, 529

[56] References Cited

U.S. PATENT DOCUMENTS

| | | | |
|---|---|---|---|
| 336,826 | 2/1886 | Steeneken | 222/105 |
| 2,659,516 | 11/1953 | Smith | 222/386.5 X |
| 2,731,297 | 1/1956 | Meyer | 222/386.5 X |
| 2,885,084 | 5/1959 | Rocca | 22/189 X |
| 3,081,911 | 3/1963 | Scholle | 222/105 X |
| 3,204,825 | 9/1965 | Underwood | 222/183 X |
| 3,212,681 | 10/1965 | Weikert | 222/183 |
| 3,219,240 | 11/1965 | Campbell | 222/183 |
| 4,214,675 | 7/1980 | Schmit | 222/105 X |

FOREIGN PATENT DOCUMENTS

| | | | |
|---|---|---|---|
| 247934 | 1/1948 | Switzerland | 222/386.5 |

*Primary Examiner*—Joseph J. Rolla
*Assistant Examiner*—Frederick R. Handren
*Attorney, Agent, or Firm*—Ben D. Tobor

[57] ABSTRACT

An apparatus for dispensing liquid with a specialized refill including a flexible reservoir and mesh screen is disclosed. The apparatus includes a housing; a flexible reservoir for storing the liquid; disposed within the housing; a flexible tubular member connected to the reservoir for selectively dispensing the liquid from the reservoir; and, a flexible mesh screen disposed within said reservoir. The flexible mesh screen produces a plurality of flow channels between the reservoir material and the output orifice of the reservoir to enable said liquid to continuously empty into said tubular member. In a preferred embodiment, the screen is a square screen with a side dimension at least equal to the diameter of the output orifice at the bottom of the reservoir and is fabricated from a plastic coated fiberglass material.

15 Claims, 5 Drawing Figures

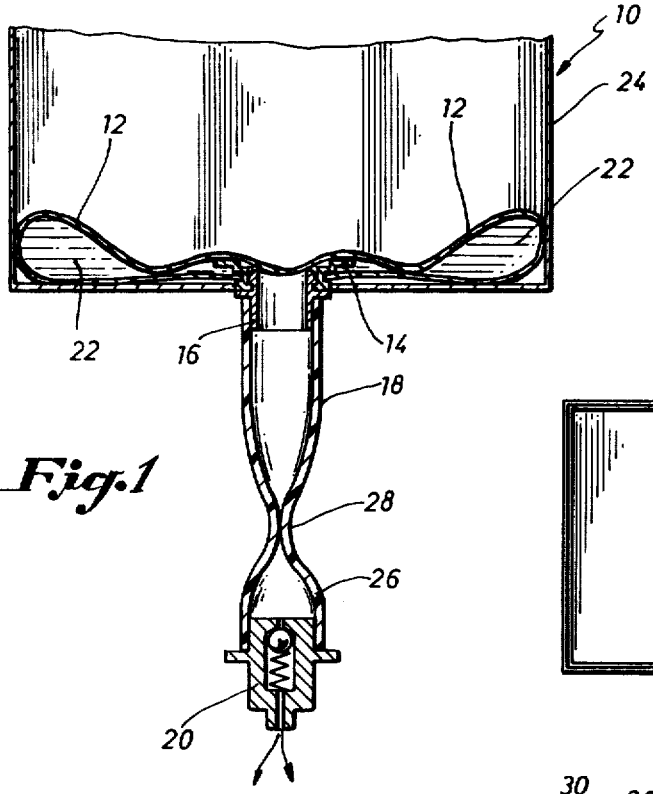
Fig. 1
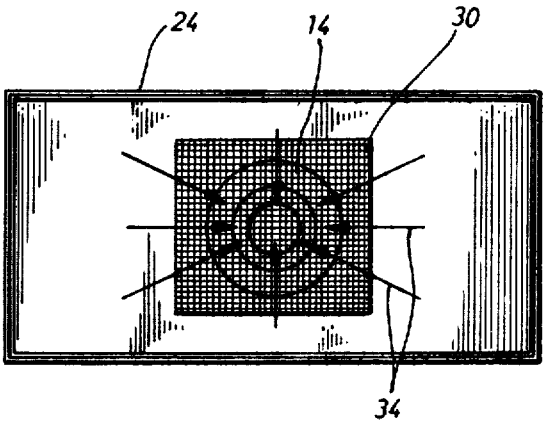
Fig. 4
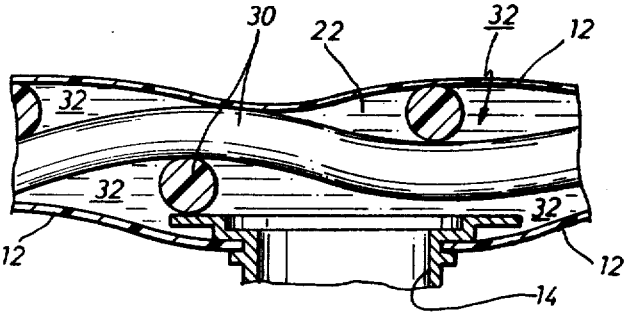
Fig. 3b
Fig. 2
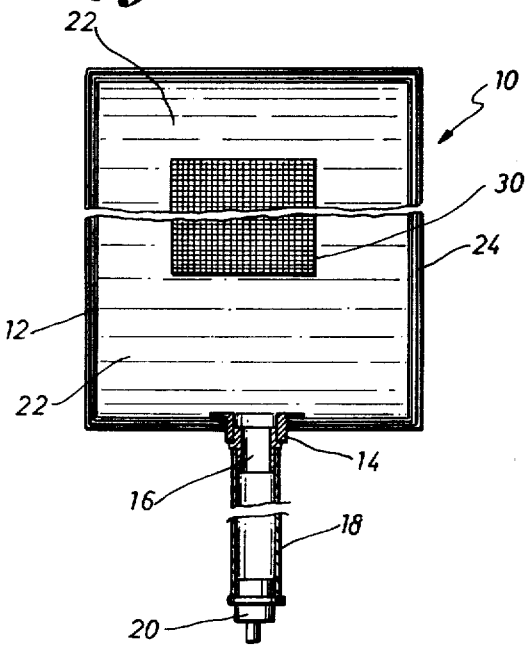
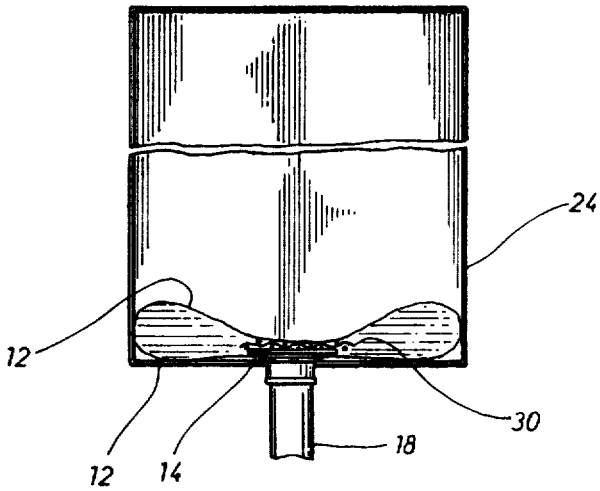
Fig. 3a

REFILL WITH FLEXIBLE MESH SCREEN FOR LIQUID DISPENSER

BACKGROUND OF THE INVENTION

This invention relates to apparatus for dispensing a liquid and more particularly to a refill for said apparatus utilizing a screen to prevent blockage of liquid out of the dispenser.

Devices for selectively dispensing liquid materials are well-known in the art. These dispensers come in a many different shapes and sizes and are used in a variety of applications including the dispensing of milk or juice in a food service environment, and the dispensing of liquid soap in kitchens and restaurant facilities.

One variety of these dispensers utilizes a flexible reservoir for storing the liquid to be dispensed. The flexible reservoirs may be bags made of plastic or other suitable materials.

There is a continuing problem of blockage in the output port of the flexible reservoirs in these liquid dispensers. Since each of the flexible reservoirs or plastic bags is provided with an opening for allowing the discharge of the fluid, this opening must remain clear for continual flow of the liquid out the opening. While the flexible reservoir is well suited to the function of discharging the fluid when in a substantially filled condition, a problem arises in the discharge of the entire contents of the reservoir. This problem may be attributed to the flexible material being sucked into the outlet thus sealing off the flow of the liquid.

It has been found that in plastic bag reservoirs holding up to five gallons of liquid to be dispensed, 8 to 20 ounces of the liquid remain in the bag when the dispenser stops pumping due to the flexible material blocking the output orifice.

Liquid dispensers utilizing a flexible reservoir are normally provided with a tubular member connected to the reservoir and extending exteriorly to the dispenser to provide access to the liquid and thus enable dispensing the liquid in selected amounts. After the flexible material is sucked into the output orifice, the flexible tube will often collapse causing a vacuum effect and thus enhancing the seal of the flexible reservoir material against the output orifice.

SUMMARY OF THE INVENTION

The apparatus of the present invention overcomes the blockage problem in a flexible reservoir system.

In accordance with the present invention, a liquid dispenser of the type utilizing a flexible reservoir system is provided. The flexible reservoir is disposed within a housing and includes an outlet port for purposes of discharging the stored liquid. The outlet port is provided with a fitment in form of an annulus which is welded to the flexible reservoir. The liquid dispenser is also provided with a tubular member connected to the annulus for selectively dispensing liquid. A mesh screen material is disposed within the reservoir, producing flow channels between the reservoir and the annulus enabling the liquid to continuously empty into the tubular member for selective disposal.

In a preferred embodiment, the reservoir is a bag made of a soft plastic such as polyurethane having a three-ply thickness with each ply 0.002 inches in thickness. The tubular member in the preferred embodiment is a flexible tubular member made of latex material. The flexible tubular member is connected to the annulus by way of tubular connection member fabricated of a hard plastic and adapted to receive said flexible tubular member on one end and interconnect into said annulus on the other end.

In the preferred embodiment, the screened mesh material is a flexible plastic coated fiberglass screen having a diameter at least equal to the diameter of the outlet port at the bottom of the reservoir.

The flexible tubular member may further include a dispensing ball check valve to assist in the selective disposal of the liquid out of the flexible reservoir. The flexible screen may be circular in shape having a diameter equal to the diameter of the outlet port at the bottom of the reservoir. The screen may also have a square configuration having its side dimension at least equal to the diameter of the outlet port at the bottom of the reservoir. Any material that can be formed into a screen mesh will be operable in this environment but the material must be compatible with the liquid to be dispensed, must not be capable of puncturing the flexible reservoir, and must not have loose pieces to prevent seating of the check valve in the tubular member.

The fitment welded to the flexible reservoir may be a multi-tiered hard plastic annulus extending from the output orifice of the reservoir, adapted to receive the tubular connection.

The presence of the flexible screen in the reservoir provides flow channels between the fitment and the flexible reservoir material when in an almost empty condition. This enables the remaining fluid in the reservoir to be expelled into the flexible tubular member and selectively dispensed thereafter.

BRIEF DESCRIPTION OF THE DRAWINGS

Other features and advantages of the present invention may be found in the detailed description of the invention hereinbelow, in conjunction with the drawings in which:

FIG. 1 is a cutaway pictorial view of a liquid dispenser with the flexible reservoir sealing off the fluid flow to the tubular member;

FIG. 2 is a pictorial view of a liquid dispenser having a flexible reservoir in a filled state and flexible screen disposed therein in accordance with the present invention;

FIG. 3A is the liquid dispenser of FIG. 2 in an almost empty state;

FIG. 3B is an enlarged view of the flexible screen providing flow channels between the flexible reservoir and the output orifice; and FIG. 4 is a top view of the flexible screen over the output orifice.

DETAILED DESCRIPTION OF THE INVENTION

A specialized refill reservoir for storing liquid to be selectively dispensed in an apparatus for dispensing liquid is provided by the present invention. The flexible reservoir is provided with a screen mesh material disposed within the reservoir thereby producing flow channels between the reservoir and the reservoir output orifice to allow for a continuous expulsion of liquid from the reservoir in both substantially full and substantially empty states.

Referring now to the drawings and more particularly to FIG. 1 where a liquid dispenser 10 is illustrated in pictorial form. The liquid dispenser 10 in FIG. 1 is provided with a flexible reservoir 12 shown in an almost empty state. The liquid dispenser is further provided with a fitment 14 welded into the flexible reservoir 12 which provides a circular outlet port as seen in FIGS. 1 and 4. A tubular connection 16 is adapted to be connected into the fitment 14 and further adapted to receive a tubular member 18. The tubular member 18 is provided with a ball check valve arrangement 20 for selectively dispensing the fluid 22 stored in the reservoir 12. The reservoir including fitment and bayonet may be disposed within a housing 24 with the tubular member 18 extending from the housing to allow access to the lower end 26 of the tubular member 18 for dispensing the liquid 22.

The condition of the liquid dispenser reservoir 12 is in an almost empty state whereby the material of the reservoir 12 is drawn into the fitment 14 thereby sealing off the fluid 22.

The seal formed over the fitment 14 may be very strong and is primarily a function of the flexibility of the material of the reservoir which in the preferred embodiment may be three layers of 0.002 inch thick plastic. The seal further persists due to a vacuum drawn by the tubular member 18 which has a tendency to collapse at point 28 once the fitment 14 is sealed.

The liquid dispenser 10 illustrated in FIG. 2 also utilizes a flexible reservoir 12 but is shown in a different condition than the reservoir 12 in FIG. 1, that is, in a substantially filled state. The reservoir 12 in FIG. 2 is also provided with a mesh screen 30. The mesh screen is illustrated in FIG. 2 to be freely suspended in the liquid 22. As the liquid is pumped out of the reservoir, the screen 30 is naturally drawn toward the fitment 14 by the flow of the liquid 22.

The hydraulic head pressure in the reservoir 12 will continue to separate the reservoir from the output orifice at fitment 14 until the reservoir 12 reaches a substantially empty condition. The mesh screen 30 is drawn to the fitment before the reservoir 12 reaches this substantially empty condition, and will provide separation between the reservoir 12 and the fitment 14 as illustrated in FIG. 3A.

Since the screen 30 must provide separation between the material of the reservoir 12 and the fitment or outlet port 14, the screen must have its smallest planar dimension at least equal to the diameter of the outlet port or fitment 14 at the bottom of the container. FIG. 3B illustrates the screen 30 in an enlarged view between the material of the reservoir 12 and the fitment 14. The screen 30 allows the flow of the liquid 22 along the plane of the screen. Due to the woven nature of the material of the screen 30, flow channels 32 are produced. The flow channels 32 allow the liquid to be dispensed through the fitment 14.

As is seen in FIG. 3B, the material of the reservoir 12 cannot completely conform to the texture of the screen 30, thereby producing many small flow channels for the liquid to flow through towards the tubular member 18 being propelled by a change in pressure to atmospheric pressure.

FIG. 4 illustrates a top view of the screen 30 over the fitment 14. As the flow lines 34 indicate, the liquid may flow in a direction parallel to the screen, perpendicular to the screen and diagonally through the screen 30.

In a preferred embodiment, the screen is fabricated from a plastic coated fiberglass material. Any material utilized in the fabrication of the screen must be compatible with the liquid to be dispensed. Further, the material must not be capable of puncturing the reservoir 12 and further must not have loose strands that would clog the seating of the ball check valve assembly 20 as shown in FIG. 1.

The fitment 14 in the preferred embodiment is a multi-tiered annulus extending from the reservoir 12 and welded thereto. The annulus is adapted to receive one section of the tubular connection 16 as a means of connecting the reservoir 12 to the tubular member 18 which is sealably fit to the opposite end of the tubular connection 16.

The geometrical shape of the screen 30 described above may be circular or square, however, the diameter dimension or side dimension respectively of the screen should be at least equal to the diameter dimension of the outlet port or fitment 14 found at the bottom of the reservoir 12.

While the invention has been described and illustrated with respect to a preferred embodiment, it will be understood by those skilled in the art that many changes and modifications may be made that are contemplated to be within the spirit and scope of the invention as defined in the appended claims.

What is claimed is:

1. An apparatus for dispensing liquid comprising:

a housing;

a reservoir for storing said liquid disposed within said housing, said reservoir having a fitment welded thereto for providing an outlet port for said liquid;

a tubular member connected to said fitment, for selectively dispensing said liquid; and a mesh screen disposed in a first position freely suspended and movable within the liquid in said reservoir, and upon the liquid being dispensed from the reservoir, the mesh screen is freely movable to a second position overlying the fitment and producing flow channels between said reservoir and said fitment, for said liquid to continuously empty into said tubular member.

2. An apparatus for dispensing liquid as set forth in claim 1 wherein said reservoir comprises a flexible plastic material.

3. An apparatus for dispensing liquid as set forth in claim 2 wherein said flexible material reservoir comprises a three-ply plastic bag with each ply having a 0.002 inch thickness.

4. An apparatus for dispensing liquid as set forth in claim 1 wherein said fitment comprises a multi-tiered hard plastic annulus extending from the said reservoir.

5. An apparatus for dispensing liquid as set forth in claim 1 wherein said tubular member is a flexible tubular member fabricated from a latex material.

6. An apparatus for dispensing liquid as set forth in claim 1 wherein said tubular member further includes a dispensing ball check valve assembly.

7. An apparatus for dispensing liquid as set forth in claim 1 wherein said mesh screen is a flexible plastic coated fiberglass material.

8. An apparatus for dispensing liquid as set forth in claim 1 wherein said mesh screen has a circular configuration with a diameter at least equal to the diameter of the fitment at the bottom of said reservoir.

9. An apparatus for dispensing liquid as set forth in claim 1 wherein said mesh screen has a square configuration with a side dimension at least equal to the diameter of the fitment at the bottom of said reservoir.

10. A liquid dispenser having a flexible reservoir for storing said liquid, said reservoir having a multi-tiered hard plastic annulus extending therefrom and welded thereto providing an output orifice; a flexible tubular member for selectively dispensing said liquid, means for connecting said flexible tubular member to said annulus for preventing leakage of said liquid from said reservoir; wherein the improvement comprises a flexible mesh screen disposed in a first position freely suspended and movable within the liquid in said reservoir, and upon the liquid being dispensed from the reservoir, the mesh screen is freely movable to a second position overlying the annulus and producing flow channels between said reservoir and said annulus for said liquid to continuously empty into said flexible tubular member.

11. An apparatus for dispensing liquid comprising:

a housing;

a flexible reservoir for storing said liquid disposed within said housing;

said flexible reservoir having a multi-tiered hard plastic annulus extending therefrom and welded thereto providing an outlet orifice;

a flexible tubular member connected to said annulus, for selectively dispensing said liquid from said reservoir;

a tubular connection member having opposed first and second extensions, said first extension adapted to connect into said annulus and said second extension adapted to receive said flexible tubular member; and a flexible mesh screen disposed in a first position freely suspended and movable within the liquid in said reservoir, and upon the liquid being dispensed from the reservoir, the mesh screen is freely movable to a second position overlying the annulus and producing flow channels between said reservoir and said annulus, for said liquid to continuously empty into said flexible tubular.

12. A refill for an apparatus for dispensing liquid including a flexible reservoir for storing said liquid, said reservoir having a multi-tiered hard plastic annulus extending therefrom and welded thereto for providing an outlet orifice; and a flexible mesh screen disposed in a first position freely suspended and movable within the liquid in said reservoir, and upon the liquid being dispensed from the reservoir, the mesh screen is freely movable to a second position overlying the annulus and producing flow channels between said reservoir and said annulus, for enabling said liquid to continuously empty from said reservoir.

13. A refill as set forth in claim 12 wherein said screen is circular with a diameter at least equal to the diameter of the outlet orifice at the bottom of said reservoir.

14. A refill as set forth in claim 12 wherein said screen is a square having a side dimension at least equal to the diameter of the outlet orifice at the bottom of said reservoir.

15. A refill as set forth in claim 12 wherein said flexible reservoir is a three-ply plastic bag with each ply 0.002 inches in thickness.

* * * * *